US005157920A

United States Patent [19]

Nakaniwa

[11] Patent Number: 5,157,920

[45] Date of Patent: Oct. 27, 1992

[54] METHOD OF AND AN APPARATUS FOR CONTROLLING THE AIR-FUEL RATIO OF AN INTERNAL COMBUSTION ENGINE

[75] Inventor: Shimpei Nakaniwa, Isesaki, Japan

[73] Assignee: Japan Electronic Control Systems Co., Ltd., Isesaki, Japan

[21] Appl. No.: 778,086

[22] PCT Filed: May 7, 1991

[86] PCT No.: PCT/JP91/00607

§ 371 Date: Dec. 12, 1991

§ 102(e) Date: Dec. 12, 1991

[87] PCT Pub. No.: W091/17349

PCT Pub. Date: Nov. 14, 1991

[30] Foreign Application Priority Data

May 7, 1990 [JP] Japan ..... 2-115892

[51] Int. Cl.[5] ..... F02D 41/14

[52] U.S. Cl. ..... 60/274; 60/276; 60/285; 123/691

[58] Field of Search ..... 123/440, 489, 589; 60/274, 276, 285; 364/431.05

[56] References Cited

U.S. PATENT DOCUMENTS 4,703,619 11/1987 Chujo et al. ..... 123/489 X
4,712,373 12/1987 Nagai et al. ..... 123/489 X
4,745,741 5/1988 Masui et al. ..... 123/489 X
4,761,950 8/1988 Nagai et al. ..... 123/489 X
4,779,414 10/1988 Nagai et al. ..... 123/489 X
4,796,425 1/1989 Nagai et al. ..... 123/489 X

FOREIGN PATENT DOCUMENTS 52-102394 8/1977 Japan .
58-48756 3/1983 Japan .
58-72647 4/1983 Japan .
62-29737 2/1987 Japan .
63-57843 3/1988 Japan .
1-300034 12/1989 Japan .

*Primary Examiner*—Willis R. Wolfe
*Attorney, Agent, or Firm*—Foley & Lardner

[57] ABSTRACT

An air-fuel ratio controlling apparatus for an internal combustion engine carries out air-fuel ratio feedback control with use of oxygen sensors, which are disposed on the upstream and downstream sides of a three-way catalytic converter respectively. A correction target value for a rich/lean balance of the feedback control carried out based on the output of the upstream oxygen sensor is corrected according to the output of the downstream oxygen sensor. A control quantity for the feedback control is corrected to reduce a difference between the correction target value and an actual value. This arrangement compensates a shift of an air-fuel ratio control point due to a change in the output characteristics of the upstream oxygen sensor, prevents an excessive deviation of an air-fuel ratio, and maintains an exhaust gas at a preferable level.

16 Claims, 6 Drawing Sheets

METHOD OF AND AN APPARATUS FOR CONTROLLING THE AIR-FUEL RATIO OF AN INTERNAL COMBUSTION ENGINE

TECHNICAL FIELD

The present invention relates to a method of and an apparatus for controlling the air-fuel ratio of an internal combustion engine, and particularly to a method of and an apparatus for detecting the air-fuel ratio of an intake air-fuel mixture to an internal combustion engine of a vehicle according to the concentration of a component contained in the exhaust on the upstream and downstream sides of the exhaust purifying catalytic converter disposed in an exhaust system of the engine, and carrying out air-fuel ratio feedback control for attaining a target air-fuel ratio according to the detected air-fuel ratio.

BACKGROUND ART

A three-way catalytic converter for purifying an exhaust is disposed in the exhaust system of an engine. For catalytic converter to maintain good converting efficiency, it is usual to carry out feedback control by having an intake air-fuel mixture to the engine maintain a theoretical air-fuel ratio.

The air-fuel ratio feedback control employs an oxygen sensor (an air-fuel ratio sensor) for detecting an air-fuel ratio according to the concentration of oxygen contained in the exhaust. To ensure good response from the oxygen sensor, the oxygen sensor is disposed at, for example, a collecting portion of an exhaust manifold in the vicinity of a combustion chamber. The oxygen sensor detects the concentration of oxygen contained in the exhaust, and according to the detected concentration, it is determined whether an actual air-fuel ratio is rich or lean with respect to a theoretical air-fuel ratio (a target air-fuel ratio). According to the rich or lean determination, the feedback control adjusts the supply of fuel to the engine.

Since the oxygen sensor is disposed close to the combustion chamber in the exhaust system, the oxygen sensor is exposed to a high-temperature exhaust, which may thermally deteriorate the characteristics of the sensor. When the oxygen sensor is located at the collecting portion of the exhaust manifold, where the exhaust from respective cylinders are not yet sufficiently mixed together, the oxygen sensor hardly detects a mean air-fuel ratio of all cylinders. This may cause a fluctuation in the air-fuel ratio detecting accuracy. Although detective response is secured by placing the oxygen sensor in the vicinity of the combustion chamber, the air-fuel ratio feedback control employing the oxygen sensor alone cannot stabilize an air-fuel ratio control accuracy.

To solve this problem, it has been proposed to arrange another oxygen sensor on the downstream side of the catalytic converter in addition to the one disposed on the upstream side thereof, and carry out the air-fuel ratio feedback control according to values detected by the two oxygen sensors (Japanese Unexamined Patent Publication No. 58-48756).

Although the downstream oxygen sensor has poor response due to an $O_2$ storage effect of the three-way catalytic converter (causing an output delay in the sensor because excessive oxygen remains when an actual air-fuel ratio is lean with respect to a theoretical air-fuel ratio and residual oxygen remains when the actual air-fuel ratio is rich), it can stably detect an air-fuel ratio at which the CO, HC and NOx converting efficiency of the three-way catalytic converter is best. The downstream oxygen sensor, therefore, can achieve accurate and stabilized detection by compensating for the deterioration of the upstream oxygen sensor.

Values detected by the two oxygen sensors may be independently used to carry out air-fuel ratio feedback control. Alternatively, a control quantity for air-fuel ratio feedback control carried out according to a value detected by the upstream oxygen sensor may be corrected such that an air-fuel ratio detected by the downstream oxygen sensor approaches a target air-fuel ratio. Namely, the upstream oxygen sensor ensures the response of air-fuel ratio control, while the downstream oxygen sensor secures control accuracy of the air-fuel ratio control, thereby precisely carrying out the air-fuel ratio feedback control.

According to the conventional air-fuel ratio control system employing two oxygen sensors, a fuel supply quantity to the engine is always directly updated according to the output of the downstream oxygen sensor. When the output characteristics of the upstream oxygen sensor change, the conventional system provides no correction target for adjusting the control to attain the target air-fuel ratio. This may cause a control overshoot, which will be explained below.

An output of the downstream oxygen sensor involves a large response delay compared with that of the upstream oxygen sensor. When the downstream oxygen sensor detects that a present air-fuel ratio is lean (rich) relative to a target air-fuel ratio, the conventional control directly corrects a fuel supply quantity to the engine, to solve the lean (rich) state. Even if an air-fuel ratio in the combustion chamber has already been inverted to a rich (lean) state from a lean (rich) state, the control for bringing an actual air-fuel ratio to the rich (lean) state is continued until the downstream oxygen sensor detects an inversion of the air-fuel ratio.

Just before an air-fuel ratio detected by the downstream oxygen sensor is inverted from rich to lean or from lean to rich, the overshoot phenomenon may occur to widely fluctuate the air-fuel ratios even if a mean air-fuel ratio is equal to the target air-fuel ratio. This overshoot may cause spikes of CO, HC, and NOx.

To solve these problems, an object of the invention is to prevent an overshoot of air-fuel feedback control caused by a detection response delay of an air-fuel ratio sensor disposed on the downstream side of a catalytic converter.

More precisely, when the output characteristics of an air-fuel ratio sensor disposed on the upstream side of the catalytic converter are deteriorated by heat, etc., a correction target value used for correcting the air-fuel ratio feedback control to attain a target air-fuel ratio is set according to a result of detection by the air-fuel ratio sensor disposed on the downstream side of the catalytic converter. The correction target value is compared with an actual value when correcting the control so that the control will no be excessively corrected beyond the correction target value, and the air-fuel ratios will not flutuate widely.

Another object of the invention is to prevent the correction target value from excessively responding to an air-fuel ratio detected by the downstream air-fuel ratio sensor and destabilizing.

Still another object of the invention is to prevent an actual value corresponding to the correction target value from being influenced by a temporary fluctuation in the air-fuel ratio feedback control, avoid a misjudgment of the air-fuel ratio feedback control, and preclude an excessive control correction.

DISCLOSURE OF THE INVENTION

To achieve the objects, a method of and an apparatus for controlling the air-fuel ratio of an internal combustion engine according to the invention basically arranges first and second air-fuel ratio sensors on the upstream and downstream sides, respectively, of an exhaust purifying catalytic converter disposed in an exhaust system of an internal combustion engine. Output values of the sensors change in response to the concentration of a specific component contained in an exhaust. This concentration changes in response to the air-fuel ratio of an intake air-fuel mixture to the engine. According to the output of the first air-fuel ratio sensor, feedback control is carried out to attain a target air-fuel ratio in an intake air-fuel mixture to the engine. These arrangements are similar to those of the prior art.

According to one characteristic arrangement of the invention, the total of lean-oriented control quantities (the total of control quantities used for bringing an actual air-fuel ratio to a lean state) as well as the total of rich-oriented control quantities (the total of control quantities used for bringing an actual air-fuel ratio to a rich state) are provided during air-fuel ratio feedback control carried out according to the first air-fuel ratio sensor. On the other hand, output values of the second air-fuel ratio sensor are used to change and set a correction target value of a parameter such as a ratio of or a difference between the totals of lean-and rich-oriented control quantities. The air-fuel ratio feedback control using the first air-fuel ratio sensor is carried out in a way to bring the parameter indicating the difference between the totals of rich- and lean-oriented control quantities close to the correction target value.

When the output characteristics of the first air-fuel ratio sensor change, i.e., when the first air-fuel ratio sensor causes a detection error for some reason, a balance of the lean- and rich-oriented control quantity totals for actually providing the target air-fuel ratio is lost. In this case, the target air-fuel ratio will not be attained if the control is carried out maintaining the original balance of the lean-and rich-oriented control quantity totals. This imbalance is detectable because an air-fuel ratio detected by the second air-fuel ratio sensor deviates from a target air-fuel ratio because of the imbalance. By changing the correction target value, which achieves a balanced state, according to output values of the second air-fuel ratio sensor, the lean- and rich-oriented control quantity totals will be balanced at a proportion corresponding to the target air-fuel ratio, and the air-fuel ratio feedback control, carried out according to detection results of the first air-fuel ratio sensor, will provide the target air-fuel ratio.

The first and second air-fuel ratio sensors may each be a sensor whose output value changes in response to the concentration of oxygen contained in an exhaust. The air-fuel ratio feedback control may be carried out according to a fuel supply quantity to the engine.

The total of lean- and rich-oriented control quantities may be calculated whenever an actual air-fuel ratio detected by the first air-fuel ratio sensor, shifts to rich or lean with respect to a target air-fuel ratio. Each of the totals may be weighted and averaged to avoid a temporary imbalance of control.

The correction target value may be changed each time by a predetermined value such that an output value of the second air-fuel ratio sensor approaches a value corresponding to a target air-fuel ratio of the air-fuel ratio feedback control. In this case, an actual air-fuel ratio achieved by the air-fuel ratio feedback control may correctly agree with the target air-fuel ratio through the control of attaining the correction target value.

There may be arranged a dead zone for output values of the second air-fuel ratio sensor. When an output value of the second air-fuel ratio sensor is within the dead zone, the correction target value will not be changed. This prevents the correction target value from being destabilized in response to the output of the second air-fuel ratio sensor.

When a control quantity is changed to produce a parameter indicating the difference between the lean- and rich oriented control quantity totals close to the correction target value, a correction value for the control quantity is set according to a deviation from the correction target value, and the control quantity is changed according to the correction value. By properly setting the correction value for the deviation, sufficient response is secured even when a deviation between an actual value and the correction target value is large, and stability is ensured even when the deviation is small.

EMBODIMENT OF THE INVENTION

Figure 1:
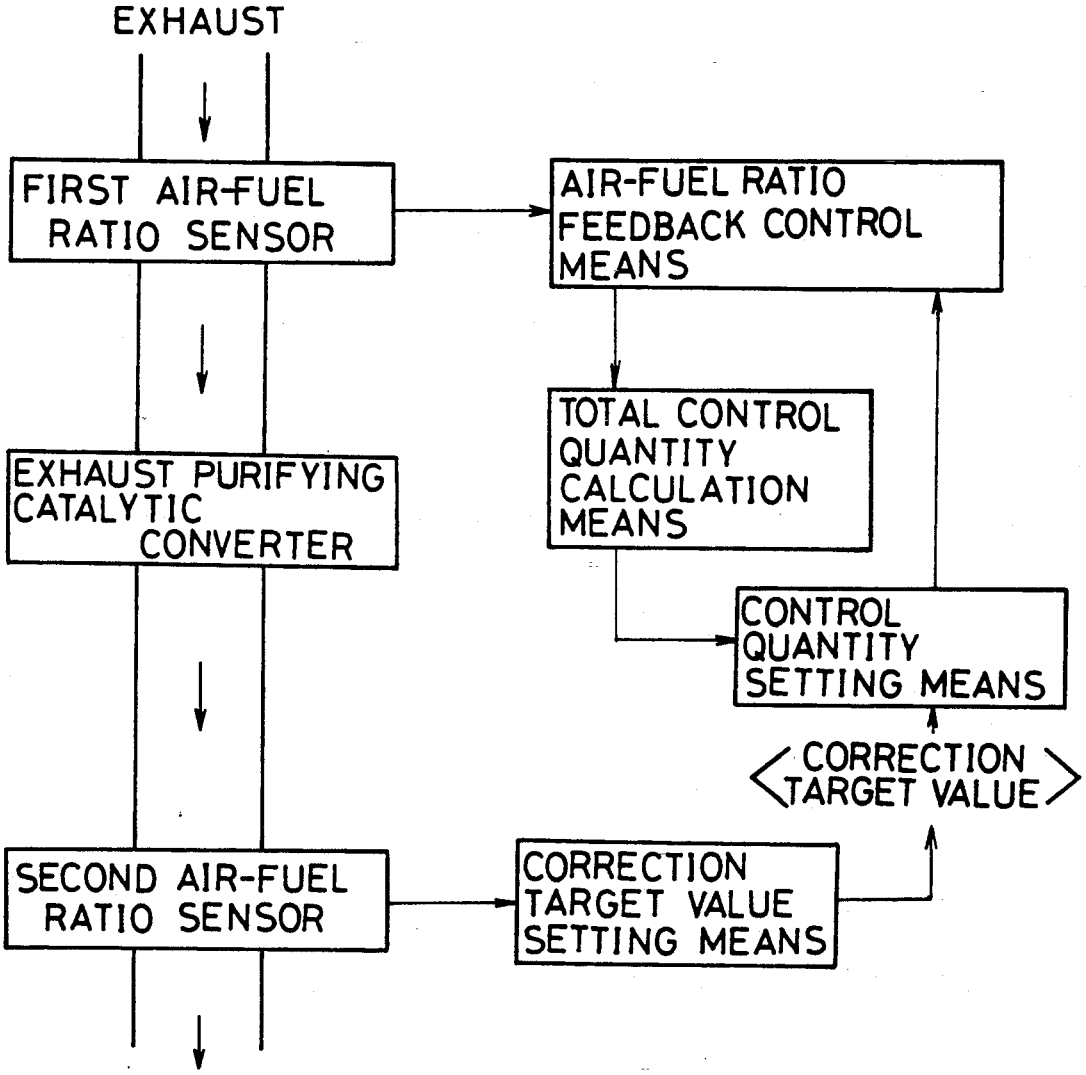
FIG. 1 is a block diagram showing a basic arrangement of an apparatus for controlling the air-fuel ratio of an internal combustion engine, according to the invention.

FIG. 1 schematically shows an arrangement of an apparatus for controlling the air-fuel ratio of an internal combustion engine according to the invention, and FIGS. 2 to 6 show a method of and an apparatus for determining and controlling the air-fuel ratio of an internal combustion engine according to an embodiment of the invention.

Figure 2:
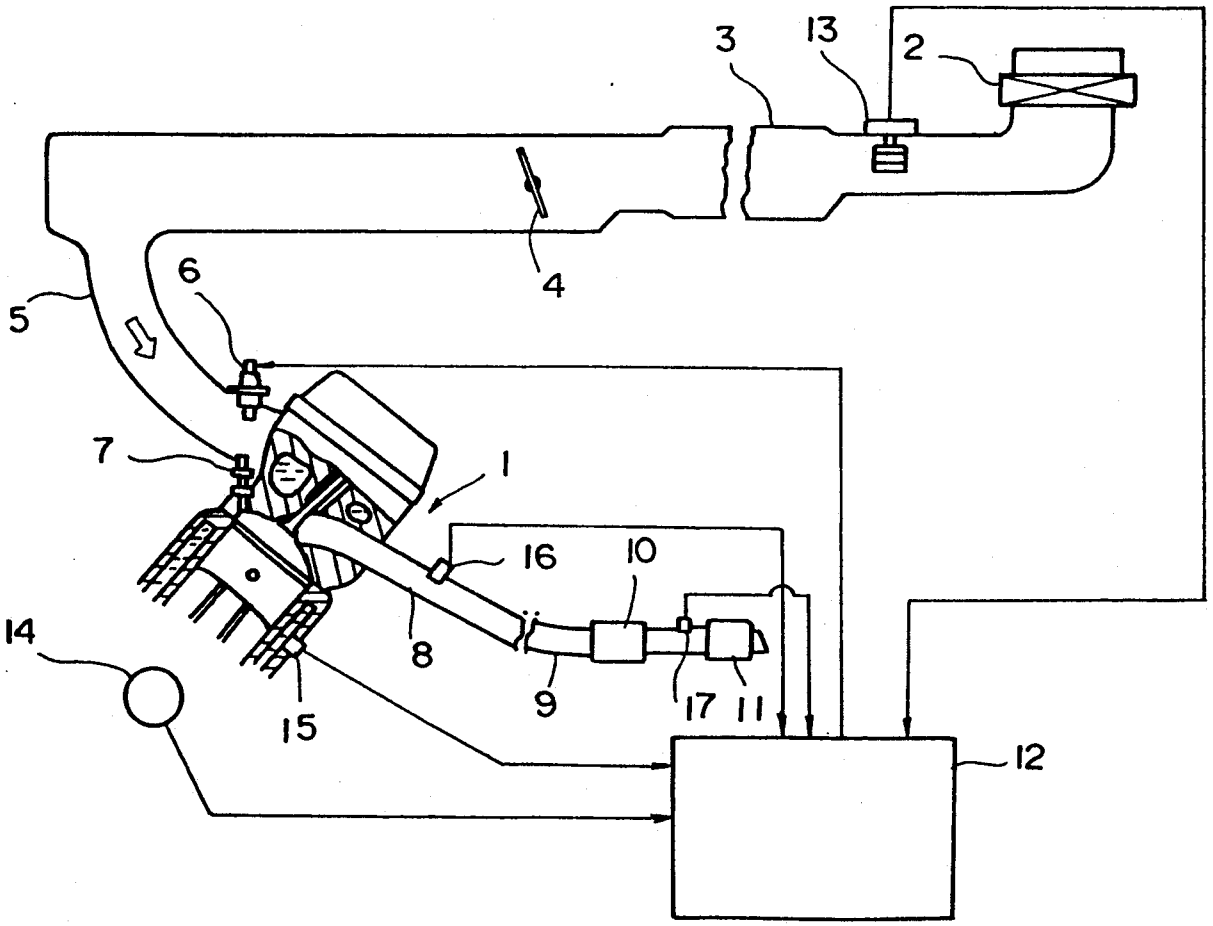
FIG. 2 is a schematic view showing a method of and an apparatus for controlling the air-fuel ratio of an internal combustion engine, according to an embodiment of the invention.

In FIG. 2, the engine 1 receives air through an air cleaner 2, an intake duct 3, a throttle valve 4, and an intake manifold 5. A fuel injection valve 6 provided for each cylinder is disposed at a branch of the intake manifold 5. The fuel injection valve 6 is a solenoid fuel injection valve, which is opened when a solenoid thereof is activated according to a drive pulse signal provided by a control unit 12 to be explained later, and closed when the solenoid is deactivated. A fuel is pressurized by a fuel pump (not shown), adjusted to a predetermined pressure through a pressure regulator, and injected from the fuel injection valve 6 into the intake manifold 5.

In this way, this embodiment employs a multiplied injection system (MPI system). The invention is also applicable for a single point injection system (SPI system) employing a single fuel injection valve located on the upstream side of the throttle valve 4 and shared by all cylinders.

An ignition plug 7 is disposed in each combustion chamber of the engine 1. An air-fuel mixture is ignited with a spark from the ignition plug 7.

Figure 6:
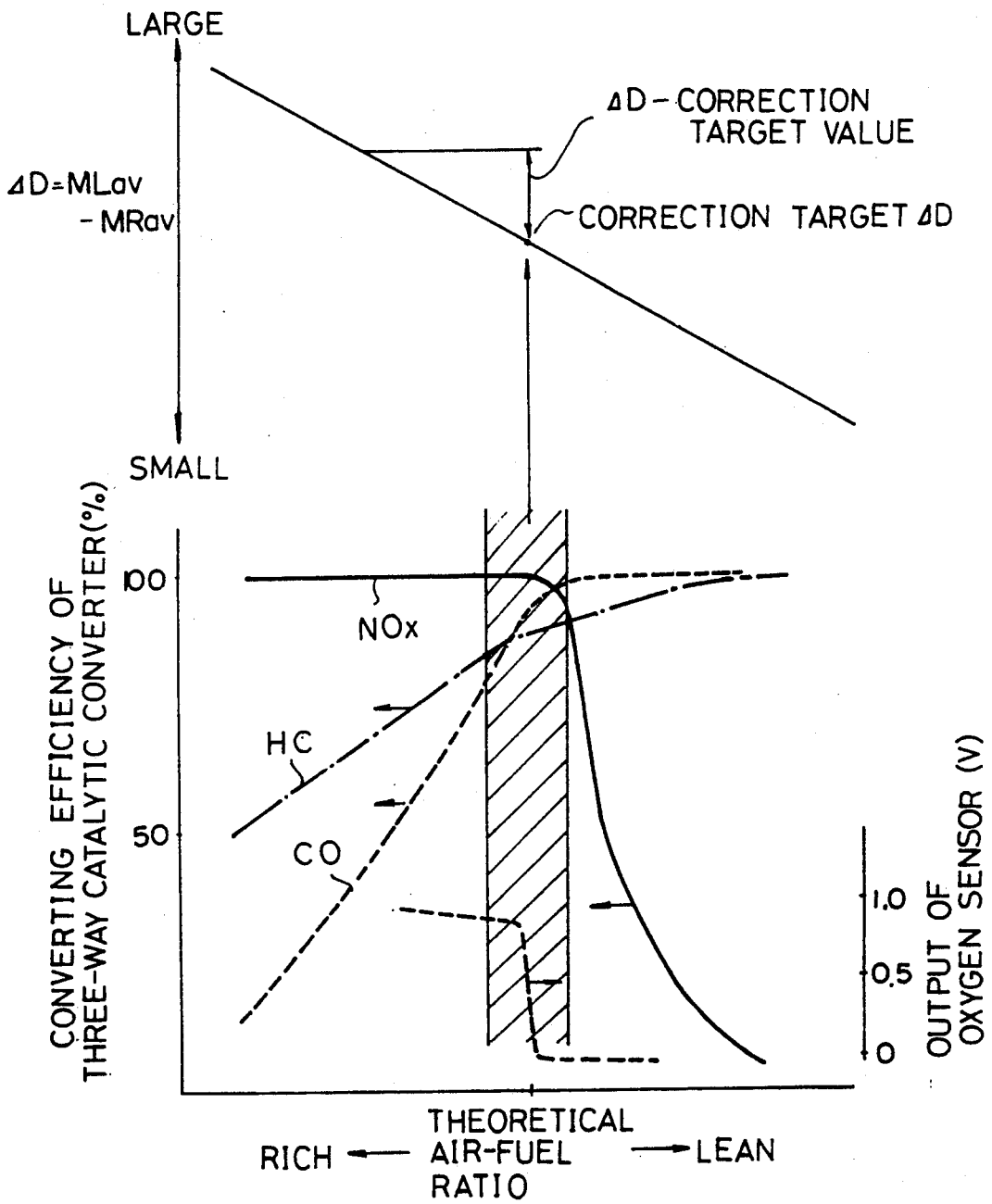
FIG. 6 is a diagram showing a relationship between the converting efficiency of a three-way catalytic converter and a correction target value according to the embodiment.

The engine 1 discharges an exhaust through an exhaust manifold 8, an exhaust duct 9, a three-way catalytic converter 10, and a muffler 11. The three-way catalytic converter 10 is an exhaust purifying catalytic converter, which oxidizes CO and HC and reduces NOx contained in the exhaust, thereby converting these components into innocuous matter. The oxidizing and reducing efficiency of the three-way catalytic converter 10 will be optimized when an intake air-fuel mixture to the engine is burned at a theoretical air-fuel ratio (FIG. 6).

The control unit 12 includes a microcomputer involving a CPU, ROM, RAM, A/D converter, and input-/output interface. The control unit 12 receives output of various sensors and processes the outputs as will be explained later, to control the fuel injection valve 6.

The various sensors include an airflow meter 13 of hot-wire type or flap type disposed in the intake duct 3. The airflow meter 13 provides a voltage signal corresponding to an intake air quantity to the engine 1.

There is also provided a crank angle sensor 14, which provides, when the engine has four cylinders, a reference signal for a crank angle of 180 degrees, and a unit signal for a crank angle of 1 or 2 degrees. A period of the reference signal, or the number of unit signals produced at a predetermined time is measured to calculate an engine rotational speed N.

A water temperature sensor 15 for detecting cooling water temperature Tw is disposed in a water jacket of the engine 1.

A first oxygen sensor 16 serving as a first air-fuel ratio sensor is disposed at a collecting portion of the exhaust manifold 8 on the upstream side of the three-way catalytic converter 10, and a second oxygen sensor 17 serving as a second air-fuel ratio sensor is disposed on the downstream side of the three-way catalytic converter 10 and on the upstream side of the muffler 11.

The first and second oxygen sensors 16 and 17 are known sensors whose output values change in response to the concentration of oxygen as a specific component contained in an exhaust gas. These oxygen sensors are rich/lean sensors, which utilize a fact that the concentration of oxygen contained in an exhaust gas changes suddenly around a theoretical air-fuel ratio. The sensors provide a voltage of about 1 V is a detected air-fuel ratio is rich relative to the theoretical air-fuel ratio, and a voltage of about 0 V is the detected air-fuel ratio is lean relative to the theoretical air-fuel ratio, according to the difference of oxygen concentration between a reference gas, i.e., atmosphere and the exhaust (FIG. 6).

Figure 3A:
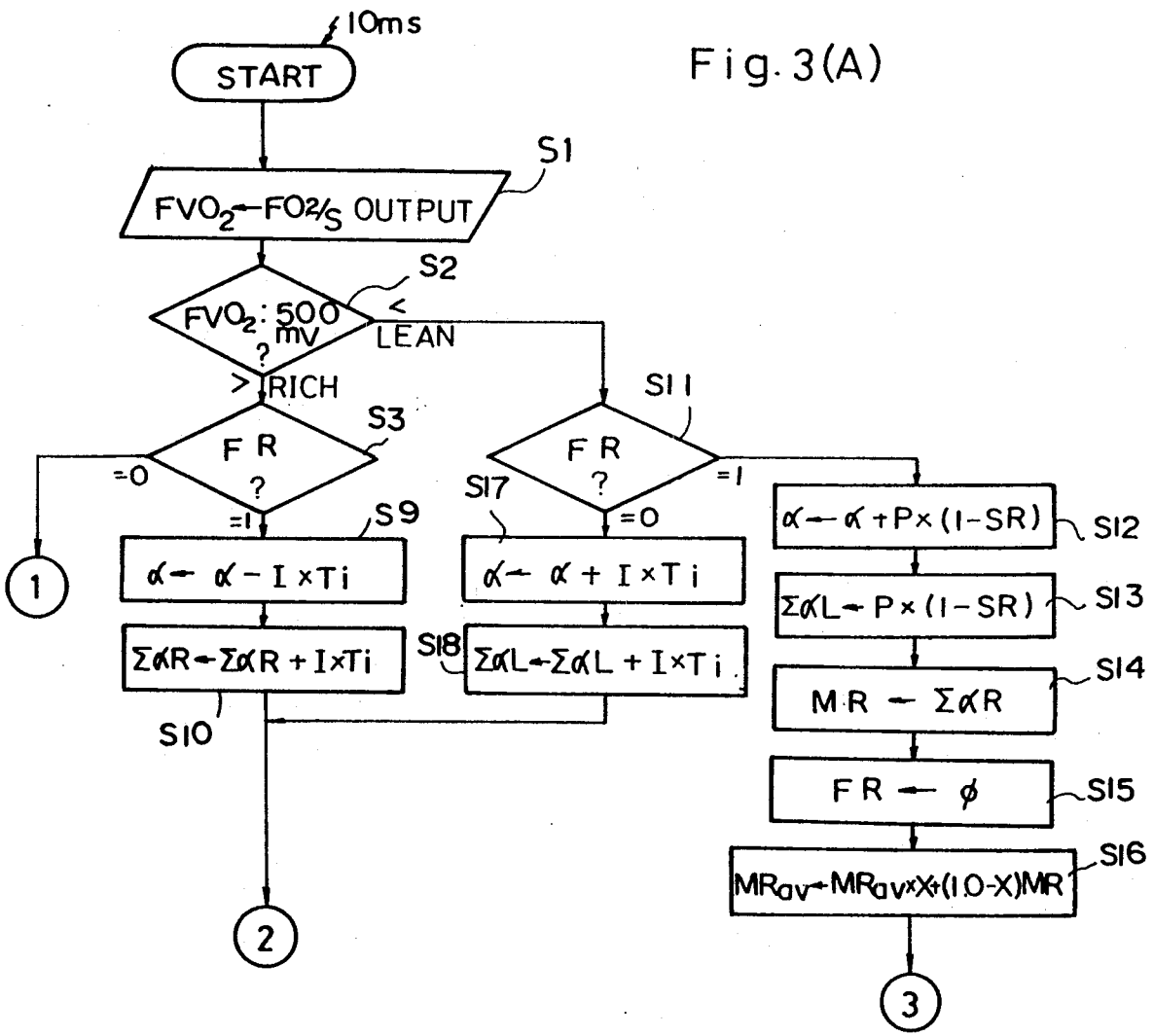
FIGS. 3(A), 3(B) and 4 are flowcharts showing air-fuel ratio feedback control according to the embodiment.
Figure 3B:
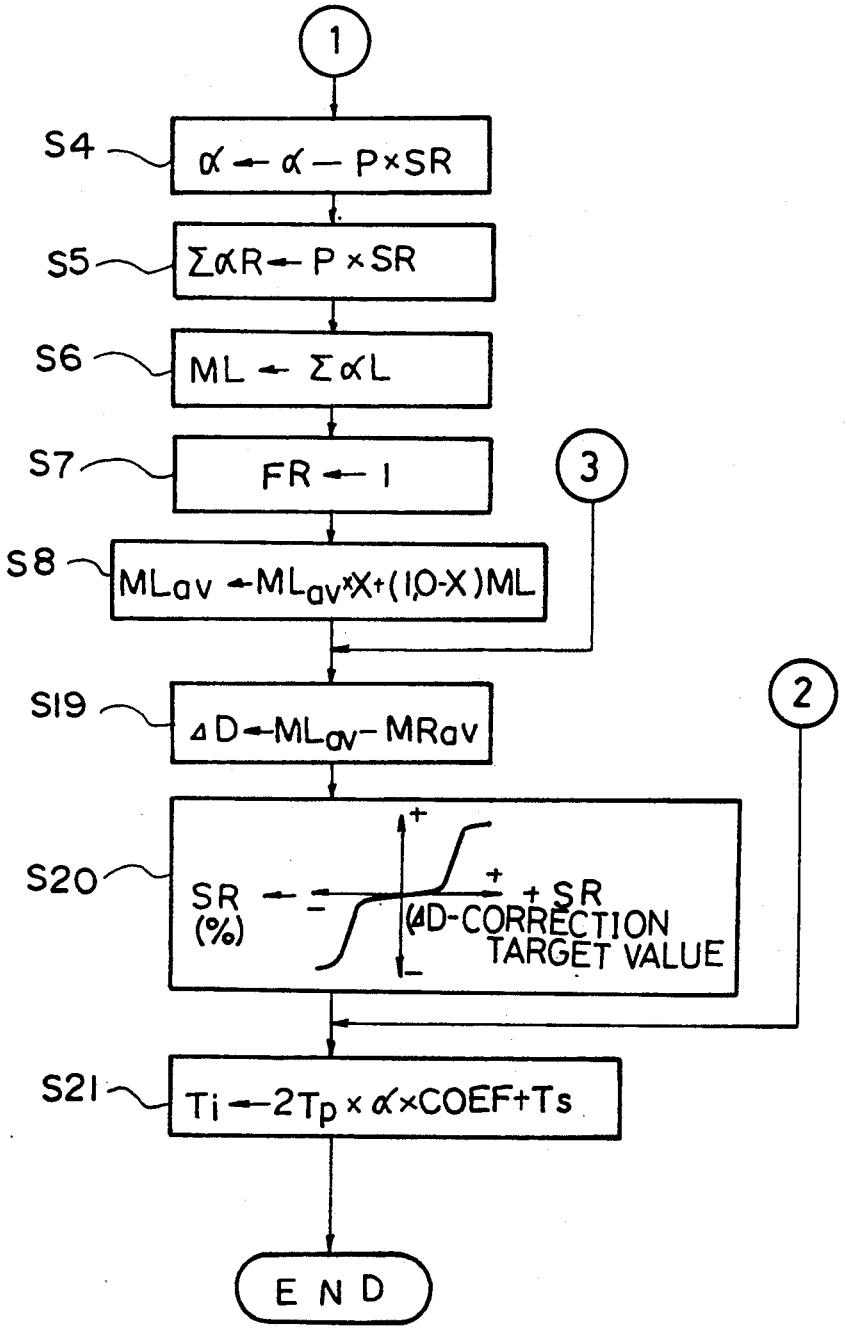
Figure 4:
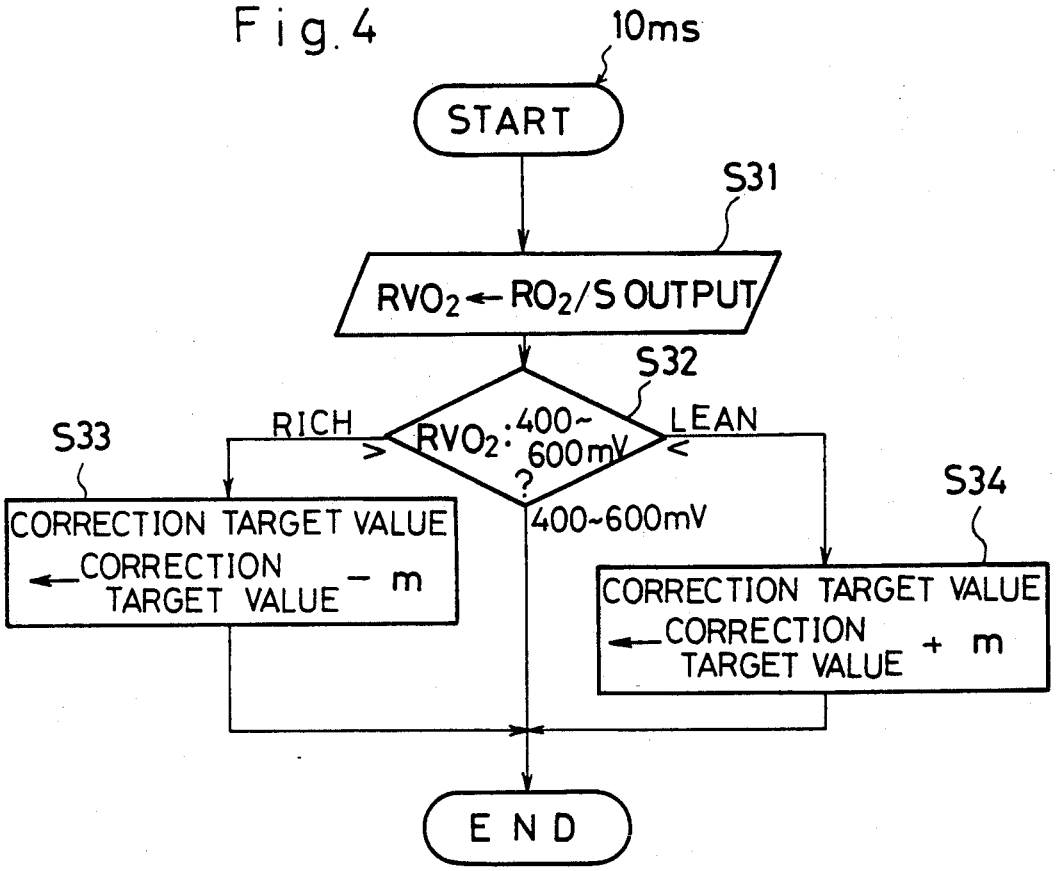

The CPU of the microcomputer incorporated in the control unit 12 carries out processes shown in flowcharts of FIGS. 3 and 4 according to programs stored in the ROM, to carry out feedback control to bring an air-fuel ratio of an intake air-fuel mixture to the engine 1 close to a target air-fuel ratio (a theoretical air-fuel ratio), thereby controlling a fuel supply quantity to the engine.

Software functions shown in the flowcharts of FIGS. 3 and 4 provided by the control unit 12 correspond to an air-fuel ratio feedback control means, total control quantity calculation means, control quantity setting means, and correction target value setting means, with these means basically forming the air-fuel ratio controlling apparatus of the invention shown in FIG. 1.

With reference to the flowcharts of FIGS. 3 and 4, the processes carried out by the microcomputer of the control unit 12 will be explained.

The processes shown in the flowchart of FIG. 3 are carried out at predetermined short intervals (for example, every 10 ms). These processes set an air-fuel ratio feedback correction coefficient $\alpha$ according to proportional-plus-integral control, correct a basic fuel injection quantity Tp according to the air-fuel ratio feedback correction coefficient $\alpha$, and set a fuel injection quantity Ti. A drive pulse signal corresponding to the fuel injection quantity Ti set with this program is provided to the fuel injection valve 6 at a predetermined timing, and the fuel injection valve 6 injects a fuel accordingly.

Step 1 (indicated as S1 in the figure) sets an output value of the first oxygen sensor 16 ($FO_2/S$), which is disposed at the collecting portion of the exhaust manifold 8 on the upstream side of the three-way catalytic converter 10, as $FVO_2$.

Figure 5:
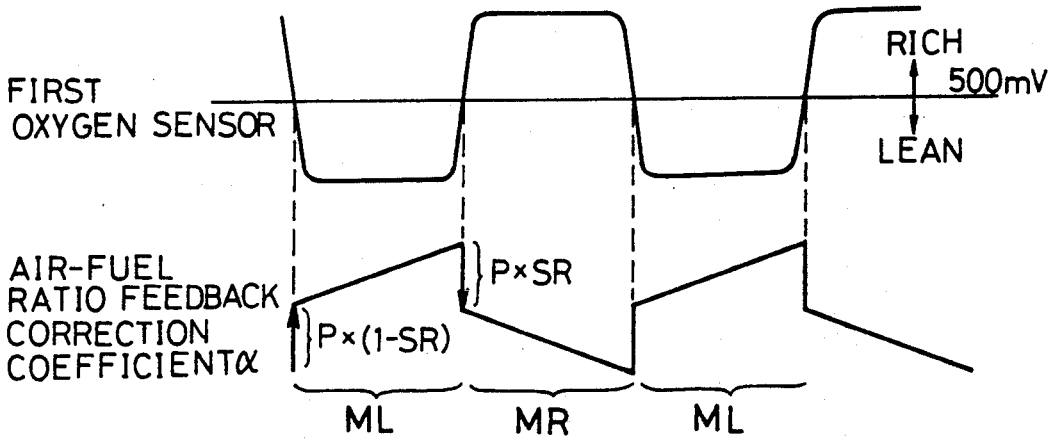
FIG. 5 is a time chart shoeing characteristic curves of changes of an air-fuel ratio feedback correction coefficient $\alpha$ according to the embodiment.

Step 2 compares the output value (voltage value) set as $FVO_2$ in Step 1 with a predetermined voltage (for example, 500 mV) that is a slice level corresponding to a target air-fuel ratio, i.e., a theoretical air-fuel ratio, and determines whether the air-fuel ratio of an intake air-fuel mixture to the engine detected by the first oxygen sensor 16 is rich or lean with respect to the theoretical air-fuel ratio (FIG. 5).

If Step 2 determines $FVO_2 > 500$ mV, i.e., if the detected air-fuel ratio is rich with respect to the theoretical air-fuel ratio, Step 3 checks a flag FR.

The flag FR is set to 0 for a first lean determination. Namely, when a rich state is inverted to a lean state for the first time, the flag FR is set to 0. The flag FR is kept at 0 during the lean state. The flag FR is set to 1 when the lean state is inverted to a rich state for the first time. If the flag FR is 0 in Step 3, it is a first inversion from lean to rich.

When step '3 determines that the flag FR is 0, i.e., the first time of inversion to rich, Step 4 reduces the air-fuel ratio feedback correction coefficient $\alpha$ (whose basic value is 1) by which the basic fuel injection quantity Tp is multiplied, according to proportional control based on the following formula:

$$\alpha \leftarrow \alpha - P \times SR$$

where P is a predetermined proportional constant serving as a control quantity for the air-fuel ratio feedback control, and SR (%) a correction coefficient (a correction value) for the proportional constant P. The correction coefficient SR is variably set according to a result of comparison of a difference between the total of incremental (rich-oriented) control quantities and the total of decremental (lean-oriented) control quantities of the air-fuel ratio feedback correction coefficient $\alpha$ with a correction target value set for the difference.

Step 5 sets a quantity of "$P \times SR$," which has been subtracted from the air-fuel ratio feedback correction coefficient $\alpha$ in Step 4, as $\Sigma\alpha R$.

Step 6 sets a sampled total $\Sigma\alpha L$ of incremental control quantities of the correction coefficient $\alpha$ as ML. The total $\Sigma\alpha L$ is a total of incremental control quantities by which the air-fuel ratio feedback correction coefficient $\alpha$ has been increased to make an air-fuel ratio rich during a period in which the air-fuel ratio has been lean. Namely, the total $\Sigma\alpha L$ is a total of increments of the correction coefficient $\alpha$ made according to the proportional-plus-integral control during a lean air-fuel ratio state just before the state has been inverted to the present rich state. After the $\Sigma\alpha L$ is set as ML, the $\Sigma\alpha L$ is reset so that the next control total may be set therein in the next lean air-fuel ratio state.

Step 7 sets the flag FR to 1. If the next cycle of this routine is again in a rich state, i.e., if the flag FR is 1 in Step 3 in the next cycle, Step 9 will be carried out.

Step 8 weights and averages the total ML of incremental control quantities of the correction coefficient $\alpha$ for the last lean state found in Step 6 and a last result of the weighted average MLav, and sets the weighted average as a new MLav.

If the flag FR is 1 indicating a continuation of a rich air-fuel state in Step 3, Step 9 gradually reduces the correction coefficient $\alpha$ according to integral control. Here, a value derived by multiplying the fuel injection quantity Ti corresponding to an engine load by a predetermined integral constant I is substrated from the correction coefficient $\alpha(\alpha \leftarrow \alpha - I \times Ti)$. In this case, a decremental control quantity (value) of the correction coefficient $\alpha$ is "$I \times Ti$."

Step 10 adds the decremental control quantity "$I \times Ti$" used in Step 9 to the $\Sigma\alpha R$, which has been set from a proportional control portion of "$P \times SR$" when a lean air-fuel ratio state has been inverted to a rich air-fuel ratio state for the first time, and provides a new $\Sigma\alpha R$. In this way, the proportional control portion "$P \times SR$" obtained when the rich air-fuel ratio is realized for the first time is added to "$I \times Ti$" whenever the integral control is carried out. Namely, the $\Sigma\alpha R$ (the total of lean-oriented control quantities) represents the total of decremental control quantities subtracted from the correction coefficient $\alpha$ during the rich air-fuel ratio state.

During a lean state, substantially the same control point that for the rich state is carried out. In proportional control carried out when the lean state is attained for the first time, a value obtained by multiplying the predetermined proportional constant P by "$1-SR$" is added to the correction coefficient $\alpha$ (Step 12). Accordingly, when the correction coefficient SR is increased, a value to be subtracted from the correction coefficient $\alpha$ according to the proportional control becomes larger, while a value to be added to the correction coefficient $\alpha$ according to the proportional control becomes smaller. As a result, an air-fuel ratio control point of the air-fuel ratio feedback control is shifted toward a lean state.

When the lean state is attained for the first time, the $\Sigma\alpha R$, that is the sampled total of decremental control quantities of the correction coefficient $\alpha$ during the last rich air-fuel ratio state, is set as MR (Step 14), and a weighted average MRav of the MR is calculated (Step 16).

During the air-fuel ratio lean state, the total of incremental control quantities of the correction coefficient $\alpha$ accumulates in $\Sigma\alpha L$ (Steps 13 and 18).

In this way, the decremental correction total MRav of the correction coefficient $\alpha$ for a rich state and the incremental correction total MLav of the correction coefficient $\alpha$ for a lean state are updated and set whenever the air-fuel ratio is inverted between the rich and lean states. These totals MRav and MLav are used in Step 19.

Step 19 is executed when the rich or lean state is attained for the first time. Step 19 finds a deviation (a parameter indicating a degree of difference) "MLav−MRav" between the weighted and averaged lean-oriented control quantity total MRav and the weighted and averaged rich-oriented control quantity total MLav. This deviation is set as $\Delta D$ and corresponds to a parameter indicating the degree of the difference between the rich- and lean-oriented control quantity totals.

Step 20 updates and sets the correction coefficient SR for the proportional constant P according to a difference "$\Delta D$−correction target value" between the deviation $\Delta D$ obtained in Step 19 and the correction target value.

When "$\Delta D$−correction target value" is substantially zero, i.e., when the deviation $\Delta D$ is substantially equal to the correction target value, the correction coefficient SR is not updated. When "$\Delta D$−correction target value" is positive, i.e., when the rich-oriented control quantity MLav is too large (the MRav is too small) relative to the correction target value, and when a control point is shifted to the rich side relative to the correction target value, the SR is corrected to the positive side.

When the correction coefficient SR increase, "$P \times SR$" increases, while "$P \times (1-SR)$" decreases, so that a rate of decrease of the correction coefficient $\alpha$ according to the proportional control in Step 4 increases, while a rate of increase of the correction coefficient $\alpha$ according to the proportional control in Step 12 decreases. As a result, when the correction coefficient SR is positively corrected, the rich-oriented control quantity MLav decreases while the lean-oriented MRav increases, and therefore, $\Delta D$ (=MLav−MRav) decreases to approach the correction target value.

If "$\Delta D$−correction target value" becomes negative, the correction coefficient SR is corrected to the negative side, so that the MLav increases and the MRav decreases to increases the $\Delta D$. As a result, the $\Delta D$ can approach the correction target value.

If "$\Delta D$−correction target value" is nearly 0, a correction value for the SR corresponding to "$\Delta D$−correction target value" is set around 0, thereby stabilizing the air-fuel ratio feedback control carried out with the $\Delta D$ being close to the correction target value. On the other hand, if "$\Delta D$−correction target value" deviates to the positive or negative side, the correction coefficient SR is widely corrected to secure response.

The correction target value for the deviation $\Delta D$ determines an actual air-fuel ratio provided by the air-fuel ratio feedback correction carried out based on the first oxygen sensor 16. Even if the output characteristics of the first oxygen sensor 16 thermally deteriorate to shift output inversion characteristics around the theoretical air-fuel ratio, the correction target value may be set to correspond to the theoretical air-fuel ratio. As a result, the feedback control based on the first oxygen sensor 16 can achieve the theoretical air-fuel ratio (FIG. 6).

During an initial state, the theoretical air-fuel ratio may be attained by feedback control with MLav: MRav=50:50. Thereafter, if the output characteristics of the first oxygen sensor 16 are changed, the theoretical air-fuel ratio may be attained by feedback control with, for example, MLav:MRav=45:55. In this case, the feedback control with MLav:MRav=50:50 will not provide the theoretical air-fuel ratio but may shift the air-fuel ratio to the rich side relative to the target. The correction target value for the ΔD, therefore, is gradually reduced to increase the SR, thereby decreasing the MLav and increasing the MRav to approach MLav:-MRav=45:55 corresponding to the theoretical air-fuel ratio (FIG. 6). Here, as will be explained later in detail, a deviation of an air-fuel ratio according to the feedback control based on the first oxygen sensor 16 is detected from the output of the second oxygen sensor 17, and according to the detected deviation, the correction target value is increased or decreased.

Once the air-fuel ratio feedback correction coefficient $\alpha$ is set in this way. Step 21, which is carried out whenever this program is executed, sets a fuel injection quantity Ti by using the correction coefficient $\alpha$.

Step 21 calculates a basic fuel injection quantity Tp (=K×Q/N, with K as a constant) according to an intake air quantity Q detected by the airflow meter 13 and an engine rotational speed N calculated based on signals from the crank angle sensor 14. Step 21 also sets a correction coefficient COEF according to engine operating conditions mainly composed of a cooling water temperature Tw detected by the water temperature sensor 15. Step 21 also sets a correction portion Ts for correcting a change caused by a battery voltage in an effective valve open time of the fuel injection valve 6. According to the correction values and air-fuel ratio feedback correction coefficient $\alpha$, Step 21 corrects the basic fuel injection quantity Tp and sets the final fuel injection quantity Ti (←2Tp×$\alpha$×COEF+Ts).

At a predetermined fuel injection timing, the control unit 12 reads the latest fuel injection quantity Ti, which is updated in Step 21 whenever this program is executed. The control unit 12 then provides the fuel injection valve 6 with a drive pulse signal having a pulse width corresponding to the fuel injection quantity Ti, thereby controlling the fuel injection quantity of the fuel injection valve 6.

It is necessary to set the correction target value for the ΔD according to the theoretical air-fuel ratio. The setting of the correction target value will be explained with reference to the flowchart of FIG. 4.

The program shown in the flowchart of FIG. 4 is executed at very short intervals (for example, every 10 ms). Step 31 sets an output voltage of the second oxygen sensor 17 disposed on the downstream side of the three-way catalytic converter 10 as $RVO_2$.

Step 32 determines whether or not the $RVO_2$, to which the output voltage of the second oxygen sensor 17 has been set in Step 31, is within a predetermined voltage range around the theoretical air-fuel ratio.

A slice level corresponding to the theoretical air-fuel ratio is, for example, 500 mV. With this value as a center, a dead zone of, for example, from 400 to 600 mV is set. If the output voltage $RVO_2$ of the second oxygen sensor 17 is within the dead zone, it is deemed that the present air-fuel ratio is in agreement with the theoretical air-fuel ratio. If the output voltage $RVO_2$ is over 600 mV, the air-fuel ratio is determined to be rich, and it is smaller than 400 mV, to be lean.

In this way, the rich or lean state is not determined by comparing the detected value with a fixed slice level. Instead, a rich or lean state is determined whether or not the detected value is within a predetermined voltage range, i.e., the dead zone. The rich/lean determination of a value detected by the first oxygen sensor 16 is preferably done by comparing the detected value with a fixed slice level, to secure a quick response speed. Since the second oxygen sensor 17 disposed on the downstream side of the three-way catalytic converter 10 has originally a low response speed, and since the second oxygen sensor 17 is only required to detect a deviation from a window shown in FIG. 6, in an air-fuel ratio provided by the air-fuel ratio feedback control carried out based on the output of the first oxygen sensor 16, the dead zone mentioned above is prepared.

Since the second oxygen sensor 17 is disposed on the downstream side of the three-way catalytic converter 10, the sensor 17 is exposed to an exhaust gas of relatively low temperature. Noxious substances such as lead and sulfur are trapped by the three-way catalytic converter 10, so that the second oxygen sensor 17 is not exposed to and deteriorated by these noxious substances. In addition, the second oxygen sensor 17 can detect the concentration of oxygen that is substantially in a balanced state because exhaust gases from respective cylinders are mixed well before reaching the second oxygen sensor 17. The detection reliability of the second oxygen sensor 17, therefore, is high compared with that of the first oxygen sensor 16. The second oxygen sensor 17 can detect a control center of repetitive rich and lean air-fuel ratios provided by the air-fuel ratio feedback control carried out according to the first oxygen sensor 16.

When Step 32 determines that the air-fuel ratio is rich out of the dead zone, the actual air-fuel ratio is on the rich side of the target, although the feedback control is carried out according to the first oxygen sensor 16 to attain the theoretical air-fuel ratio. In this case, Step 33 reduces the correction target value for the ΔD by a predetermined small quantity m (for example, 0.0001%).

This correction target value is used in Step 20 of the flowchart of FIG. 3. When the correction target value is reduced, "ΔD−correction target value" is shifted toward the positive side to increase the correction coefficient SR. When the correction coefficient SR is increased, a quantity, by which the correction coefficient $\alpha$ is reduced by the proportional control, is increased. On the other hand, a quantity (=P×SR), by which the correction coefficient $\alpha$ increases, is decreased. As a result, the decremental control quantity MRav increases, and the incremental control quantity MLav is reduced. Accordingly, "ΔD=MLav−MRav" is reduced, and "ΔD=MLav−MRav" approaches the correction target value that has been reduced after detection of the rich state.

While the second oxygen sensor 17 is continuously detecting the rich state, the correction target value is gradually reduced by a predetermined small quantity m. This quantity m is sufficiently small, while the speed of ΔD approaching the target is relatively high, so that the ΔD rapidly approaches the target value to substantially zero the correction quantity for the correction coefficient SR. By repeatedly correcting the correction coefficient SR, the correction target value will correspond to the theoretical air-fuel ratio, and the ΔD will finally correspond to the theoretical air-fuel ratio. As a result, the original feedback control, in which an air-fuel ratio detected by the second oxygen sensor 17 substantially agrees with the theoretical air-fuel ratio, is restored.

If Step 32 determines that the air-fuel ratio is lean, Step 34 increases the correction target value by the predetermined quantity m, thereby increasing the ΔD more than the present value. As a result, similar to the previous case, an air-fuel ratio realized by the air-fuel ratio feedback control will agree with the theoretical air-fuel ratio.

When the first oxygen sensor 16, which is easily affected by heat and noxious substances, is affected to change its output characteristics, the air-fuel ratio feedback control using initially set control constants may cause a deviation of air-fuel ratio from the target air-fuel ratio, i.e., the theoretical air-fuel ratio. In this case, the above technique can compensate for the deviation and correct the feedback control to provide a theoretical air-fuel ratio.

Even if the speed of changing the target is very small, no problem arises because the characteristics of the first oxygen sensor 16 do not suddenly deteriorate.

The correction target value that is increased or decreased according to an air-fuel ratio detected by the second oxygen sensor 17 is compared with an actual ΔD, and according to a result of the comparison, a control quantity (the correction coefficient SR for correcting the proportional constant P) of the proportional control is changed. Accordingly, it is easy to widely change the control quantity when the actual ΔD is far from the correction target value, and slowly change the control quantity when the ΔD is close to the target. This technique can ensure control response while suppressing an overshoot (a lean or rich spike) when the ΔD approaches the correction target value. Accordingly, this technique can restrict the width of deviation of an air-fuel ratio, and maintain good converting efficiency from the three-way catalytic converter 10.

The correction target value is set to precisely provide the theoretical air-fuel ratio according to the air-fuel ratio feedback control carried out based on the output of the second oxygen sensor 17. The control quantity is corrected according to a deviation in an actual value from the correction target value. By properly correcting the control quantity, a useless air-fuel ratio deviation is prevented. Even with oxygen sensors that merely detect whether or not an actual air-fuel ratio is rich or lean with respect to a target air-fuel ratio as in the embodiment, a deviation in the actual air-fuel ratio from the target air-fuel ratio is apparently corrected.

To carry out a rich/lean determination in Step 32, a detected value may be compared with slice level of, for example, 500 mV. The dead zone of this embodiment, however, is useful for detecting a rich or lean state according to the second oxygen sensor 17 and avoiding unnecessary increasing or decreasing the control quantity (the proportional constant P) around a target air-fuel ratio.

If the oxygen sensors 16 and 17 can linearly measure an air-fuel ratio, it is possible to determine the deviation of an actual air-fuel ratio detected by the second oxygen sensor 17 from a target air-fuel ratio, at which the best converting efficiency of the three-way catalytic converter 10 is achieved. The predetermined small quantity m by which a correction target value is increased or decreased as shown in the flow chart of FIG. 4, therefore can be changed according to the deviation of the air-fuel ratio. In this case, the responsiveness is further improved, and the width of deviation of an air-fuel ratio can be suppressed to a predetermined width in which the storage effect of the three-way catalytic converter is demonstrated.

According to the embodiment, the deviation ΔD is obtained as a parameter indicating a difference between the decremental correction total MRav and incremental correction total MLav, and the control quantity for the proportional control is increased or decreased to bring the deviation ΔD close to the target. Instead, the same effect will be obtained by using a ratio of the decremental correction total MRav to the incremental correction total MLav as a parameter for indicating the degree of the difference between the totals, and by bringing the ratio close to the target.

CAPABILITY OF EXPLOITATION IN INDUSTRY

As explained above, a method of and an apparatus for controlling the air-fuel ratio of an internal combustion engine according to the invention stabilizes the accuracy of air-fuel ratio feedback control for a long time, and sufficiently suppresses a fluctuation of an air-fuel ratio. The invention is most appropriate for controlling the air-fuel ratio of an electronically controlled fuel injection gasoline internal combustion engine, and remarkably effective for improving the quality and performance of the internal combustion engine.

I claim:

1. A method of controlling the air-fuel ratio of an internal combustion engine, employing first and second air-fuel ratio sensors disposed on the upstream and downstream sides, respectively, of an exhaust purifying catalytic converter disposed in an exhaust system of the internal combustion engine, output values of the air-fuel ratio sensors changing in response to the concentration of a specific component contained in an exhaust from the engine, the concentration changing according to the air-fuel ratio of an intake air-fuel mixture to the engine, comprising a step of carrying out feedback control for controlling the air-fuel ratio of the intake air-fuel mixture to the engine to a target air-fuel ratio according to the output of the first air-fuel ratio sensor, a step of calculating the total of lean-oriented control quantities and the total of rich-oriented control quantities applied for an air-fuel ratio during the air-fuel ratio feedback control, a step of variably setting, according to the output of the second air-fuel ratio sensor, a correction target value for a parameter indicating the degree of difference between the totals, and a step of variably setting a control quantity for the air-fuel ratio feedback control to let the parameter indicating the degree of difference between the totals agree with the correction target value.

2. A method of controlling the air-fuel ratio of an internal combustion engine according to claim 1, wherein the first and second air-fuel ratio sensors change their output values in response to the concentration of oxygen contained in the exhaust.

3. A method of controlling the air-fuel ratio of an internal combustion engine according to claim 1, wherein the air-fuel ratio feedback control is carried out on the quantity of a fuel supplied to the engine.

4. A method of controlling the air-fuel ratio of an internal combustion engine according to claim 1, wherein the total of lean-oriented control quantities and the total of rich-oriented control quantities are found when an actual air-fuel ratio detected by the first air-fuel ratio sensor is inverted from rich to lean or from lean to rich with respect to the target air-fuel ratio.

5. A method of controlling the air-fuel ratio of an internal combustion engine according to claim 1, wherein each of the totals of lean- and rich-oriented control quantities is weighted and averaged.

6. A method of controlling the air-fuel ratio of an internal combustion engine according to claim 1, wherein the correction target value is gradually changed by a predetermined amount so that the output of the second air-fuel ratio sensor may approach a value corresponding to the same target air-fuel ratio as that for the air-fuel ratio feedback control.

7. A method of controlling the air-fuel ratio of an internal combustion engine according to claim 1, wherein a predetermined dead zone is prepared for output values of the second air-fuel ratio sensor, and when an output value of the second air-fuel ratio sensor is within the dead zone, the correction target value is unchanged for the moment.

8. A method of controlling the air-fuel ratio of an internal combustion engine according to claim 1, wherein a correction value for the control quantity is set according to a deviation of the parameter indicating the difference between the lean- and rich-oriented control quantity totals and the correction target value, and the control quantity is changed according to the correction value.

9. An apparatus for controlling the air-fuel ratio of an internal combustion engine comprising:

first and second air-fuel ratio sensors disposed on the upstream and downstream sides, respectively, of an exhaust purifying catalytic converter disposed in an exhaust system of the internal combustion engine, whereby output values of the air-fuel ratio sensors change in response to the concentration of a specific component contained in an exhaust from the engine, and the concentration changes according to the air-fuel ratio of an intake air-fuel mixture to the engine;

an air-fuel ratio feedback control means for carrying out feedback control for controlling the air-fuel ratio of an intake air-fuel mixture to the engine to a target air-fuel ratio according to the output of the first air-fuel ratio sensor;

a total control quantity calculation means for calculating the total of lean-oriented control quantities and the total of rich-oriented control quantities for an air-fuel ratio during the air-fuel ratio feedback control;

a control quantity setting means for variably setting a control quantity used for the air-fuel ratio feedback control means so that a parameter indicating the degree of difference between the total of lean-oriented control quantities and the total of rich-oriented control quantities calculated in the total control quantity calculation means becomes equal to the correction target value; and a correction target value setting means for changing the correction target value according to an output value of the second air-fuel ratio sensor.

10. An apparatus for controlling the air-fuel ratio of an internal combustion engine according to claim 9, wherein the first and second air-fuel ratio sensors change their output values in response to the concentration of oxygen contained in the exhaust.

11. An apparatus for controlling the air-fuel ratio of an internal combustion engine according to claim 9, wherein the air-fuel ratio feedback control means carries out feedback control on the quantity of a fuel supplied to the engine, thereby controlling the air-fuel ratio of an intake air-fuel mixture to the engine to the target air-fuel ratio.

12. An apparatus for controlling the air-fuel ratio of an internal combustion engine according to claim 9, wherein the total of lean-oriented control quantities and the total of rich-oriented control quantities are found when an actual air-fuel ratio detected by the first air-fuel ratio sensor is inverted from rich to lean or from lean to rich with respect to the target air-fuel ratio.

13. An apparatus for controlling the air-fuel ratio of an internal combustion engine according to claim 9, wherein the total control quantity calculation means obtains each of the lean- and rich-oriented control quantity totals through a weighted average operation.

14. An apparatus for controlling the air-fuel ratio of an internal combustion engine according to claim 9, wherein the correction target value setting means gradually changes the correction target value by a predetermined amount so that the output value of the second air-fuel ratio sensor may approach a value corresponding to the same target air-fuel ratio as that for the air-fuel ratio feedback control.

15. An apparatus for controlling the air-fuel ratio of an internal combustion engine according to claim 9, wherein a predetermined dead zone is prepared for output values of the second air-fuel ratio sensor, and when an output value of the second air-fuel ratio sensor is within the dead zone, whereby the correction target value setting means does not change the correction target value for the moment.

16. An apparatus for controlling the air-fuel ratio of an internal combustion engine according to claim 9, wherein the control quantity setting means sets a correction value for the control quantity according to a deviation of the parameter indicating the difference between the lean- and rich-oriented control quantity totals from the correction target value, and changes the control quantity according to the correction value.

* * * * *